106-74 AU 115 EX
8/10/76 XR 3,973,998

United States Patent [19]

Datta et al.

[11] 3,973,998

[45] Aug. 10, 1976

[54] RINSING SOLUTIONS FOR ACID CLEANED IRON AND STEEL SURFACES

[75] Inventors: Vijay Jang Datta, Louisville; John David White, Prospect, both of Ky.

[73] Assignee: Celanese Coatings & Specialties Company, Louisville, Ky.

[22] Filed: May 5, 1975

[21] Appl. No.: 574,214

[52] U.S. Cl. ..... 148/6.14 R; 134/27; 134/28; 134/29; 106/74; 427/309; 427/327; 252/527

[51] Int. Cl.[2] ..... C23C 9/02

[58] Field of Search ..... 134/27, 28, 29; 427/344; 106/74; 252/135, 527; 148/6.14 R

[56] References Cited

UNITED STATES PATENTS

| | | | |
|---|---|---|---|
| 1,555,798 | 9/1925 | Gravell | 148/6.15 R |
| 3,154,438 | 10/1964 | Keller et al. | 148/6.15 |
| 3,368,913 | 2/1968 | Ziehr et al. | 427/330 X |
| 3,699,052 | 10/1972 | Petrey et al. | 252/389 |
| 3,847,663 | 11/1974 | Shumaker | 134/2 |

*Primary Examiner*—Ralph S. Kendall
*Attorney, Agent, or Firm*—Herbert P. Price; K. A. Genoni; T. J. Morgan

[57] ABSTRACT

Metal surfaces, after being cleaned of rust with an aqueous acid solution, are rinsed with an aqueous solution of a chelating agent and an ammonium or alkali metal silicate. Such rinsed surfaces remain rust free for extended periods of time. When coated with primer and top-coat paints, excellent durability and corrosion resistance are obtained.

8 Claims, No Drawings

RINSING SOLUTIONS FOR ACID CLEANED IRON AND STEEL SURFACES

BACKGROUND OF THE INVENTION

The field of art to which this invention pertains is acid cleaning of rusty steel.

Rusty iron and steel surfaces have long been cleaned by sand blasting prior to being coated and painted. However, due to various air pollution laws, iron and steel fabricators have been resorting to acid cleaning to remove the rust. One method of acid cleaning is to spray the rusty surface with a hot aqueous solution of an acid, e.g., phosphoric acid, for a time sufficient to remove the rust. The acid drainoff is circulated through an ion exchange resin, make-up acid is added and the acid solution is reused. The acid treated steel surface must then be rinsed to remove residual acid and other contaminants left on the surface by the acid. If water is used as the rinse, the surface will begin to rust almost immediately. It is preferred to use a passivating rinse, i.e., a rinse which will render the steel passive to corrosion for a short period of time. Many of these rinses, however, interfere with the subsequent adhesion of protective coatings to the metal surface. Acid treatment (pickling), corrosion inhibition and passification of iron and steel are discussed in Kirk-Othmer "Encyclopedia of Chemical Technology", 2nd Ed., Vol. 6, pages 321–324, Vol. 13, pages 288–291.

U.S. Pat. No. 3,847,663 describes a method for cleaning the surfaces of metals during the processing of the metals, e.g., immediately after the metal is drawn. The foreign matter which is removed from the metal is chiefly drawing oils and the like. The cleaning compositions are aqueous solutions of alkali metal silicates and chloride plus, preferably, surfactants and chelating agents.

In U.S. Pat. No. 3,154,438, a method is described for preparing metal surfaces to receive an adherent coating of water soluble base paints by acid cleaning the metal followed by rinsing it with an aqueous amine solution.

In U.S. Pat. No. 3,368,913, acid treated steel is rinsed with an aqueous solution of a polyalkanolamine and an alkali.

Corrosion inhibitors containing a glycine, a chelating agent, phosphoric or boric acid ester and a water soluble divalent metal salt are described in U.S. Pat. No. 3,699,052.

SUMMARY OF THE INVENTION

This invention pertains to the acid cleaning of rusty metal. In particular this invention relates to the rinsing of the metal surface after the acid cleaning step. More particularly, this invention pertains to a method for rinsing iron or steel surfaces after rust removal by acid cleaning, whereby immediate re-rusting is inhibited and whereby good adhesion of a subsequent protective coating to the metal surface is obtained. In another aspect this invention relates to an aqueous composition useful for rinsing metal surfaces after acid cleaning.

In the process of this invention, the metal surface is first cleaned of rust by acid treatment. The so treated surface is then rinsed with an aqueous solution of a chelating agent an an ammonia or alkali metal silicate. The amount of chelating agent used is in the range of about 0.25 to about 3 percent by weight based on the total weight of the aqueous solution. The amount of silicate used is in the range of about 5 to about 15 percent by weight based on the total weight of the aqueous solution.

Metal surfaces which have been treated by the process of this invention stay rust free for a long period of time and do not have to be painted immediately after being treated. When painted, the coated surfaces exhibit extended durability in corrosive environments.

DESCRIPTION OF THE INVENTION

The chelating agents useful in this invention are those which are capable of forming a complex with iron atoms. Examples of useful chelating agents are ethylene diamine tetraacetic acid and its tetrasodium slat, N,N,N′,N′-tetrakis (2-hydroxypropyl)-ethylene diamine, triethanol amine, trimethylenediaminetetraacetic acid, nitrilotriacetic acid, nitrilodipropionic acid, ethyleneglycol-bis-(beta-aminoethyl ether)-N,N-tetraacetic acid, pentasodium salt of diethylenetriaminepentaacetate, trisodium salt of N-hydroxyethylethylenediaminetriacetate and the like. Mixtures of these chelating agents can also be used. The chelating agents are used in the amount of about 0.25 to about 3 weight percent based on the total weight of the rinse solution and preferably about 1 to about 2 weight percent.

The silicates useful in this invetnion are those silicates which are soluble or colloidally dispersible in water, e.g., ammonia and alkali metal silicates. Suitable silicates are sodium disilicate, potassium disilicate, sodium metasilicate, potassium metasilicate, lithium metasilicate, sodium orthosilicate, potassium orthosilicate and lithium orthosilicate. Since the alkali metal silicates generally exist as mixtures rather than as the pure compounds, the compositions can be expressed as the weight ratio of alkali metal oxide to silicon dioxide. Commercial sodium silicate, water glass, has a ratio of $SiO_2$ to $Na_2O$ between 2 and 4 and such compositions are useful in this invention. Potassium silicates can also be expressed in the same manner with useful ratios of $K_2O:SiO_2$ of about 1.5 to 3. Lithium silicate is also useful in this invention and is described in U.S. Pat. No. 3,455,709. Such silicates have $SiO_2:Li_2O$ mol ratios between 4.5:1 and 25:1. Additional silicates are the ammonium silicates which are aqueous colloidal silicas stabilized with ammonium ion.

The ammonium or alkali metal silicate is used in the amount of about 5 to about 15 weight percent based on the weight of the rinse solution and preferably about 6 to about 9 weight percent.

In carrying out the process of this invention an aqueous solution of an acid is sprayed onto the rusty surface of the iron or steel objects for a time sufficient to remove the rust. Useful acids are phosphoric acid, sulfuric acid, hydrochloric acid, citric acid, oxalic acid, gluconic acid and the like. The preferred acid is phosphoric acid. Generally the concentration of the acid will range from about 3 to about 20 weight percent of the total weight of acid cleaning solution. In order to facilitate the wetting of the rusty surface, a wetting agent can be added. Such wetting agents are anionic and nonionic surfactants. Useful nonionic surfactants are polyethers, e.g., ethylene oxide and propylene oxide condensates in general, which include straight- and branch-chain alkyl and alkylaryl polyethylene glycol ethers and thioethers and polypropylene glycol ethers and thioethers, and more particularly substances such as members of a homologous series of alkylphenoxypoly(ethyleneoxy)ethanols. These non-ionic surfactants include alkylphenoxypoly(ethyleneoxy)ethanols having alkyl groups containing between about 4 to about 240 ethyleneoxy units, such as the heptylphenoxypoly(ethyleneoxy)ethanols, nonylphenoxypoly(ethyleneoxy)ethanols and dodecylphenoxypoly(ethyleneoxy)ethanols. Other suitable non-ionic surfactants are the polyoxyalkylene derivatives of hexitol (including sorbides, mannitans and mannides) anhydride, partial long chain fatty acid esters, such as the polyoxyalkylene derivatives of sorbitan monopalmitate, sorbitan monostearate, sorbitan tristearate, sorbitan monooleate and sorbitan trioleate; the condensates of ethylene oxide with a hydrophobic base, said base being formed by condensing propylene oxide with propylene glycol; sulfur-containing condensates, e.g., those prepared by condensing ethylene oxide with higher alkyl mercaptans, such as nonyl, dodecyl, or tetradecyl mercaptan, or with alkylthiophenols wherein the alkyl substituent contains from 6 to 15 carbon atoms; ethylene oxide derivatives of long-chain carboxylic acids such as lauric, myristic, palmitic or oleic acid, or mixtures of acids, such as tall oil, and ethylene oxide derivatives of long-chain alcohols such as octyl, decyl, lauryl or cetyl alcohol.

Among the anionic surfactants suitable for use in the present invention are the higher molecular weight sulfates and sulfonates, e.g., sodium and potassium alkyl sulfates, aryl sulfates, and alkylaryl sulfates and sulfonates, including sodium 2-ethylhexylsulfate, potassium 2-ethylhexyl sulfate, sodium nonyl sulfate, sodium undecyl sulfate, sodium tridecyl sulfate, sodium pentadecyl sulfate, sodium lauryl sulfate, sodium methylbenzene sulfonate, potassium methylbenzene sulfonate, sodium dodecylbenzene sulfonate, potassium toluene sulfonate and sodium xylene sulfonate; higher fatty alcohols, e.g., stearyl alcohol, lauryl alcohol, and the like, which have been ethoxylated and sulfonated; dialkyl esters of alkali metal sulfosuccinic acid salts, e.g., sodium diamyl sulfosuccinate, sodium dihexyl sulfosuccinate and sodium dioctyl sulfosuccinate; and formaldehyde-naphthalenesulfonic acid condensation products. Preferably, nonionic surfactants are used in the acid cleaning solution. The amount of surfactant used will vary from about 0.05 to about 0.2 weight percent based on the total solution weight.

The acid cleaning solution can be applied at room temperature but it is preferred to apply it at elevated temperatures up to about 85°C. and preferably 60°C. to 80°C.

During the cleaning process, the sprayed acid cleaning solution is collected, passed through an ion exchange solution, fresh acid is added to make up the concentration of acid to its original concentration, and this solution is resprayed over the rusty surface. Spraying with recycling is continued until the surface is substantially cleaned of rust. After the rust has been removed, the surface is then sprayed with the rinse solution for a time sufficient to remove all the residual acid from the metal surface. This rinsing step is generally conducted at ambient temperatures although temperatures ranging from about 15°C. to about 80°C. can be used with no detrimental effects. Surfaces which have been rinsed with the rinse solution of this invention stay rust free even under humid conditions for a period of from about 5 to about 15 days. It has been theorized that the chelating agent forms a soluble stable complex with the free metal ion and prevents the formation of insoluble oxides and hydroxides. It also appears that the silicate reacts with excess acid on the metal surface and covers the entire surface with a thin insoluble film which acts as a barrier in the electrolytic conduction paths between anodes and cathodes.

After the metal surface has been cleaned and rinsed, it is then coated with metal primers and top coats which protect and decorate the metal. It has been found that the coatings which have been applied over metals which have been rinsed with the solution of this invention, exhibit excellent exposure and corrosion resistance.

The following examples will illustrate in more detail the subject matter of this invention. Parts and percentages where used are parts and percentages by weight unless otherwise noted.

EXAMPLE 1

To a suitable container was added an aqueous cleaning solution containing 6 percent phosphoric acid, 0.2 percent diethylthiourea and 0.1 percent octylphenoxypolyethoxyethanol with the remainder being water. The cleaning solution was heated to 66°C. and was then pumped through a spray device over 4 inch × 12 inch rusty steel panels, made from sandblasted steel which had been rusted by being placed in a salt spray booth for 3 to 4 hours. The acid cleaning solution was sprayed over the panels until the red rust was removed and the panels were light gray in color.

The acid cleaned panels were then rinsed on both sides to remove residual cleaning solution. The rinse solution contained 8 percent lithium silicate and 1 percent of the tetrasodium salt of ethylene diamine tetraacetic acid with the remainder being water. The rinsed panels were then dried in air at room temperature. These panels remained rust free for 2 to 3 weeks while exposured to the atmosphere at room temperature (25°C.) and a relative humidity of 65 percent.

EXAMPLE 2

The procedure described in Example 1 was repeated except 2 percent rather tha 1 percent of the chelating agent, the tetrasodium salt of ethylene diamine tetraacetic acid, was used in the rinse solution. Acid cleaned panels rinsed with this solution remained rust free for 3 weeks even though exposed to a relative humidity of 100 percent.

EXAMPLE 3

Example 1 was repeated using aqueous rinse solutions containing 1 percent N,N,N′,N′-tetrakis (2-hydroxypropyl)ethylene diamine and 1 percent triethanol amine, respectively. Results equal to those obtained in Example 1 were obtained.

EXAMPLE 4

Panels rinsed as described in the preceding example were primed with rust inhibiting paints, e.g., Cathacoat 302, a zinc rich coating described in U.S. Pat. No. 3,408,318, or Devran 201, an anticorrosive epoxy/polyamide coating, both obtainable from Celanese Coatings and Specialties Company, and topcoated with Devran 215, an epoxy/polyamide tank coating also obtainable from Celanese Coatings and Specialties Company. These coated panels passed the Navy Cycle Test with no evidence of rusting and paint delamination. The Navy Cycle Test involves 20 cycles comprising (A) salt water (3% NaCl) immersion for 1 week; (B) aromatic fuel immersion for 1 week; (C) hot seawater (175°F.) immersion for 2 hours; and (D) hot seawater (175°F.) spray for 10 seconds, wherein (A), (B), (C) and (D) comprise one test cycle. Acid treated panels, not rinsed or rinsed only with water, and coated as described above, failed after one or two cycles.

It is to be understood that the foregoing detailed description is given merely by way of illustration and that many variations may be made therein without departing from the spirit of the invention.

What is claimed is:

1. The process of acid cleaning of rusty iron and steel, the improvement which comprises rinsing the acid cleaned steel with an aqueous solution consisting essentially of a chelating agent capable of forming a complex with iron atoms and an ammonium or alkali metal silicate wherein the chelating agent is present in the amount of about 0.25 to about 3 percent by weight and the silicate is present in the amount of about 5 to about 15 percent by weight, said precents being based on the total weight of the aqueous solution.

2. The process of claim 1 wherein the chelating agent is present in the amount of about 1 to about 2 percent by weight based on the total weight of the aqueous solution.

3. The process of claim 1 wherein the silicate is present in the amount of about 6 to about 9 percent by weight based on the total weight of the aqueous solution.

4. The process of claim 1 wherein the chelating agent is the tetrasodium salt of ethylene diamine tetraacetic acid.

5. The process of claim 1 wherein the chelating agent is triethanol amine.

6. The process of claim 1 wherein the chelating agent is N,N,N′,N′-tetrakis (2-hydroxypropyl)ethylene diamine.

7. The process of claim 1 wherein the silicate is a sodium silicate.

8. The process of claim 1 wherein the silicate is a lithium silicate.

* * * * *